US007195394B2

(12) United States Patent
Singh

(10) Patent No.: US 7,195,394 B2
(45) Date of Patent: Mar. 27, 2007

(54) METHOD FOR RESONANT WAVE MIXING IN CLOSED CONTAINERS

(76) Inventor: Vijay Singh, 391 Mt. Harmony Rd., Bernardsville, NJ (US) 07924

( * ) Notice: Subject to any disclaimer, the term of this patent is extended or adjusted under 35 U.S.C. 154(b) by 290 days.

(21) Appl. No.: 10/787,656

(22) Filed: Jul. 19, 2004

(65) Prior Publication Data

US 2006/0013063 A1 Jan. 19, 2006

(51) Int. Cl.
*B01F 11/00* (2006.01)

(52) U.S. Cl. ..... 366/211; 366/237; 366/239

(58) Field of Classification Search ..... 366/210, 366/211, 237, 239; 435/303.3
See application file for complete search history.

(56) References Cited

U.S. PATENT DOCUMENTS

| | | | | |
|---|---|---|---|---|
| 643,094 | A * | 2/1900 | Hensel | 4/541.1 |
| 715,301 | A * | 12/1902 | Schodron | 366/210 |
| 1,937,422 | A | 11/1933 | Bonish | |
| 3,132,848 | A | 5/1964 | Garlinghouse | |
| 3,297,152 | A | 1/1967 | Corella et al. | |
| 3,583,400 | A | 6/1971 | Memhardt et al. | |
| 3,698,494 | A | 10/1972 | Gaudin | |
| 3,735,964 | A | 5/1973 | Lorenzen | |
| 3,788,611 | A | 1/1974 | Barbini | |
| 3,819,107 | A | 6/1974 | Ryder, Jr. | |
| 3,860,219 | A | 1/1975 | Nickerson, Jr. | |
| 3,924,700 | A | 12/1975 | Lindsey et al. | |
| 4,146,364 | A | 3/1979 | McCormick | |
| 4,470,705 | A | 9/1984 | Boice et al. | |
| 4,557,377 | A | 12/1985 | Maloney | |
| 4,622,760 | A | 11/1986 | Schumacher | |
| 4,784,297 | A | 11/1988 | Katz | |
| 4,841,848 | A * | 6/1989 | Baker et al. | 99/277.2 |
| 4,907,723 | A * | 3/1990 | Katz | 222/105 |
| 5,071,760 | A | 12/1991 | Watanabe et al. | |
| 5,362,642 | A | 11/1994 | Kern | |
| 5,680,110 | A | 10/1997 | Whisson | |
| 5,775,974 | A | 7/1998 | Hulsebus | |
| 6,190,913 | B1 | 2/2001 | Singh | |
| 6,946,242 | B2 * | 9/2005 | Looney | 435/2 |

* cited by examiner

*Primary Examiner*—David Sorkin
(74) *Attorney, Agent, or Firm*—Ostrolenk, Faber, Gerb & Soffen, LLP

(57) ABSTRACT

A method and apparatus is provided for non-invasively mixing ingredients in closed containers. Mixing is performed by inducing waves in the liquid to be mixed. This is achieved by rocking the container in precise phase so as to produce resonance. With the waves moving back and forth in resonance, it is possible to mix with very low energy requirements compared to prior art. Mixing ingredients with resonant waves in a closed container eliminates the need for an invasive mixer and has obvious advantages in minimizing contamination. This makes the device ideal for biological processing that typically require sterile operation.

6 Claims, 4 Drawing Sheets

METHOD FOR RESONANT WAVE MIXING IN CLOSED CONTAINERS

BACKGROUND OF THE INVENTION

1. Field of the Invention

The present invention relates to mixing of ingredients in closed containers, which may be rigid or flexible, such as bags. Typical applications are pharmaceutical and biological manufacturing, and involve the dissolution of solids, reconstitution of biological media, and mixing of sterile suspensions.

2. Description of the Related Art

In various industries, especially pharmaceuticals, many materials are stored in disposable plastic bottles and bags. These one-use containers are very cost effective because they do not require to be cleaned and sterilized prior to and after use. Such bags and bottles are used to store dry ingredients prior to reconstitution, such as components for buffers and liquids such as culture media; or solutions, such as intermediate products prior to further processing.

The major limitation to the increased use of such containers is the inability to mix the ingredients contained in the bag. This is especially serious with large bags (capacities of 10 to 1000 liters) which cannot be shaken by hand. Current art requires that the contents of the bag be transferred to a mixing tank and the ingredients mixed by a conventional paddle or impeller-type mixer. After mixing, the ingredients need to be transferred back into a bag for storage. This method has several drawbacks—1) the need for an expensive rigid mixing tank and mixer that must be cleaned before and after use; 2) the need for a second disposable container for the material after mixing; 3) difficulty in maintaining sterility during this operation; and 4) significant labor-intensive fluid transfers.

Attempts have been made to mix ingredients inside a bag. One method is to provide a dip tube and to use an external pump to pump the contents of the bag through a tubing loop back into the bag (U.S. Pat. No. 5,362,642). This method is of very limited effectiveness. Firstly, materials tend to sediment in the corners of the bag where the dip tube cannot reach, so that they are never dispersed. Secondly, for effective mixing a high pump-around flow rate is required. In a non-rigid container, such as a bag, suction develops near the intake of the dip tube due to the high flowrate. This causes the wall of the bag to collapse, choking off the flow in the pump-around loop and decreasing the mixing efficiency. Another method that has been reported, is the insertion of a magnetic stirrer assembly into the bag prior to fill. The bag is then positioned on a motorized drive assembly that forces the magnetic stir bar inside the bag to rotate. This technique has the advantage that it provides a non-invasive means of agitating the contents of the bag. However, a simple calculation of power input and fluid properties will show that this method cannot impart sufficient energy to mix a bag larger than say 5 liters in volume within a reasonable period of time. Thus, it is useless for the majority of mixing applications that involve mixing 10 to 1000 liters of liquid in a bag.

A common method for non-invasively mixing viscous fluids, such as paint, is the use of high frequency shakers. Examples are Micin (U.S. Pat. No. 3,788,611), Powell (U.S. Pat. No. 4,662,760) and Lorenzen (U.S. Pat. No. 3,735,964). These devices are designed to be operated at 1000 or more cycles per second and angles of oscillation of 20 to 120 degrees. They are restricted to small volumes (less than 4 liters) since the cost of mechanisms necessary to handle the inertia and momentum of greater masses is prohibitive. The mixing conditions cited in these shaker patents are far too harsh for biological fluids. It is also doubtful that a flexible bag could be made that would withstand this high speed shaking. Thus, such shaking devices are of little use in developing a method for mixing large volumes (5 to 1000 liters) of biological fluids.

Another technique uses a kneading motion to mix inside the bag. U.S. Pat. Nos. 3,297,152, 3,819,107, 4,557,377 and 5,779,974 have specialized bag designs, some with multiple internal pockets, that are used to mix specific components. Examples are epoxy resins and food ingredients. While these methods are quite efficient, they are not useful for general purpose use nor can they be scaled up to the large volumes necessary. These methods are not usable with standard storage bags, which consist of a single chamber of "pillow" or "cube" construction with single inlet and outlet ports.

The idea of using a rocking motion to mix liquids is not new. U.S. Pat. No. 1,937,422 employs a rocking platform to mix photographic solutions in a tray. U.S. Pat. No. 4,146,364 utilizes the concept to mix liquid in test tubes. The obvious extension of this rocking idea is to use a bag or similar flexible container to contain the liquid to be mixed and then place the bag inside a rocking tray. Numerous U.S. patents (U.S. Pat. Nos. 3,583,400, 3,698,494, 3,924,700, and 5,680,110) have been granted for this idea which is quite successful for small bags (less than 500 ml) that are commonly used for blood collection. Another application is a rocking apparatus for cell culture (U.S. Pat. No. 5,071,760). U.S. Pat. No. 3,788,611 has a variant of this idea for small flasks.

U.S. Pat. No. 4,784,297 discloses a beverage mixer based on rocking a filled flexible bag. While this is apparently successful, the patent requires the rocking motion to be in excess of 100 revolutions per minute. Practical experience and numerous citations demonstrate that with a biological solution, such as culture media, such a high agitation rate would cause foaming and rapidly degrade any proteinous components. The reason for this poor mixing efficiency is the lack of gas-filled headspace in the mixing bag of Katz. While others (U.S. Pat. No. 4,470,703) have recognized the importance of free headspace in a mixing bag, this was not foreseen nor was it obvious to Katz.

Very little prior art describes a mixing method or apparatus for large mixing bags (volume greater than 5 liters). Most are limited to blood bags (100 to 1000 ml). Some examples for larger bags are Garlinghouse (U.S. Pat. No. 3,132,848) and Nickerson (U.S. Pat. No. 3,860,219). These applications are for mixing viscous materials such as cement slurry. The method employed by Nickerson envisions essentially rolling the mixing through 180 degrees or even tumbling through 360 degrees. These techniques are not suitable for low viscosity (1 to 20 cP) fluids typical of biological applications. Garlinghouse proposes a wide variety of rocking and mixing mechanisms. Some limitations are worthy of note as they will become apparent when considering the present invention. Firstly, the rocking tilt angle required for mixing is determined by Garlinghouse to be between 5 and 30 degrees. The second item of note is that Garlinghouse specifically restricts the operation of the device to where the generated wave " . . . is not one which is productive of a resonant effect . . . ."

One method for mixing large volumes of fluid is by Singh (U.S. Pat. No. 6,190,913). However, the primary purpose of this method is for cell culture where aeration is the main objective. The rocking motion necessary for mixing utilizing this method requires a high rocking rate (10 to 30 revolutions per minutes) and relatively high angle (5 to 10 degrees) of tilt. These conditions result in an expensive bag necessary to withstand the high stresses resulting from the high rocking rate and angle. The energy consumption to achieve mixing is also quite large, making this method not very desirable for mixing applications, especially for large volumes.

Accordingly, there is a need for a method for mixing ingredients within a standard storage bag using a non-invasive apparatus that can handle volumes up to 1000 liters. For the method to be successful it must therefore:

be able to utilize bags of standard design and construction;

be able to handle bag volumes up to 1000 liters without leakage;

provide sufficient mixing to provide a homogeneous environment and disperse components in a reasonably short (few minutes) processing time;

maintain a sterile and closed environment in the bag; and be low cost by reducing mechanical and instrumentation complexity to a minimum.

The present invention will provide a new and improved method for mixing ingredients in a bag that achieves all these criteria and overcomes all the aforementioned prior art limitations.

OBJECTS AND ADVANTAGES

Key objects and advantages of the present invention are:

(a) Provides a means for mixing materials contained in bags without direct contact or the need to pump out the contents. This facilitates the use of disposable bags or similar disposable plastic containers for media and buffer preparation. Such bags or rigid containers could be provided presterilized by heat or radiation.

(b) Provides a non-invasive means of agitation that reduces mechanical complexity and possibility of contamination. This mode of agitation also minimizes local high shear fields that may cause product damage. By operating at a resonant condition, the energy input for mixing is significantly reduced over other methods.

(c) It eliminates the need for labor-intensive cleaning, preparation and sterilization of stainless steel mixing tanks typically necessary for mixing; by allowing mixing within the primary pre-sterilized disposable one-use device. The low mechanical complexity of the present invention reduces operating and maintenance costs.

(d) Provides complete isolation of ingredients in the bag from the environment during mixing, allowing the bag to be handled in a non-aseptic environment, making it useful for the production of sterile materials, or mixing of pathogens, viruses and other substances requiring a high degree of containment. This "closed" operation may be achieved by using a sealed bag, or by providing filtered vents that prevent to influx or venting of contaminants.

Further objects and advantages of my invention will become apparent from a consideration of the drawings and ensuing description.

Figure 1:
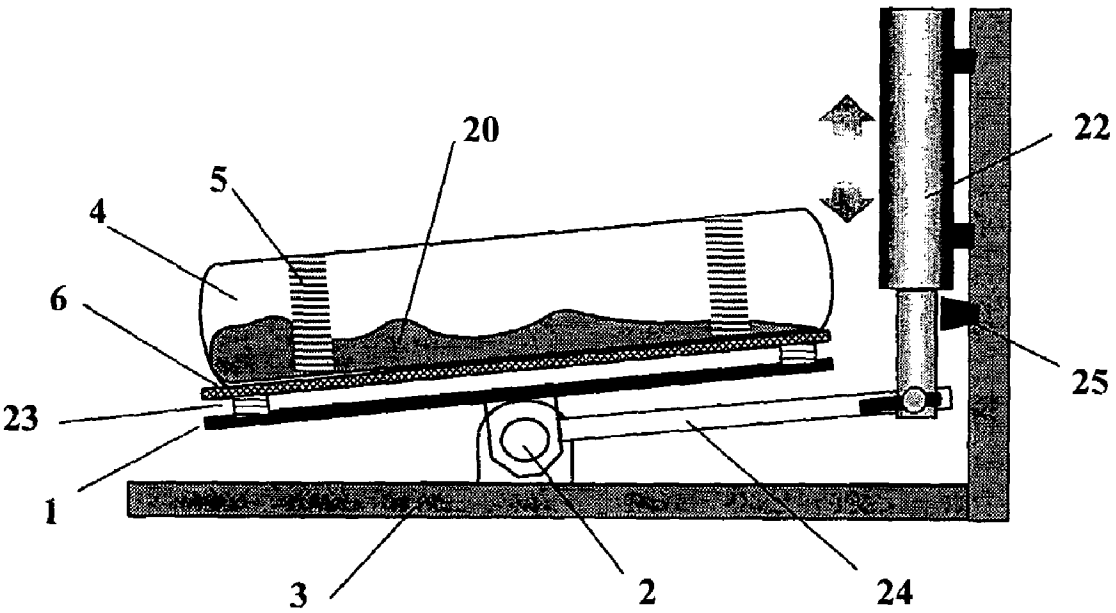
FIG. 1 is a side view of the apparatus for mixing ingredients in a bag.

The following are the Reference Numerals in the drawings:

1 Rocking platform.
2 Pivot point for rocking motion.
3 Baseplate.
4 Bag containing ingredients to be mixed.
5 Restraining clamps.
6 Bag holder.
20 Liquid in bag.
22 Electric linear actuator.
23 Load sensors.
24 Drive arm.
25 Position sensor.
30 Tilt axis.
31 Baffles.

SUMMARY OF THE INVENTION

The present invention provides an apparatus for mixing ingredients and liquid, said apparatus comprising:

(a) a platform capable of holding said container containing said ingredients and liquid; and (b) means for tilting from side to side through an angle said platform with a pause in tilting motion at each side, wherein said pause varies in length in order to allow for the creation of a resonant wave in said liquid.

The present invention also provides a method of mixing ingredients and liquid in a container comprising tilting said container containing said ingredients and liquid through an angle on a platform from one side to the other back and forth with a pause in tilting motion at each side, wherein said pause varies in length in order to allow for the creation of a resonant wave in said liquid.

DETAILED DESCRIPTION OF THE INVENTION

The present invention has been developed through many investigations to develop a low cost and simple solution to the problem of mixing ingredients in a low viscosity (1–10 cP) liquid contained in a non-rigid container, such as a sealed plastic bag. Extension can be made to rigid containers provided sufficient headspace (10–20%) is available for wave propagation.

The method consists of rocking a container filled with the ingredients to be mixed. The container is typically partially full (up 80%), however if the container is non-rigid and very flexible, such as plastic bag, it is possible to eliminate the headspace requirement entirely. The container is placed on a platform that is able to rock through an angle of typically 1 to 10 degrees with respect to the horizontal datum. Unlike all prior art the platform is not rocked at a constant speed. Instead, the platform is rapidly tilted from one side to the other. This motion accelerates the fluid in the container on the platform and it surges with a wave-like motion to the other side. Based on the geometry of the container, it is possible to calculate the time it takes for the liquid to reach the other end. Once the wave hits the end, it reflects and moves back in the opposite direction. Again, it reflects and changes direction. This to and fro motion occurs multiple times and finally dies out. By tilting the platform back and forth at precisely the right time it is possible to perpetuate this resonant motion indefinitely. Thus a resonant wave is induced that moves with great force from one side to the other with the inducing platform reinforcing the motion using small, but carefully timed energy inputs. In this manner, the device operates much like a child's swing. The induced resonant wave motion promotes dispersement of the ingredients to be mixed. It also sweeps up and suspends solid ingredients off the bottom and promotes dissolution. Mixing times to achieve homogeneity are typically less than one minute.

By increasing the tilt angle it is possible to control the turbulent intensity of the agitation. With small tilt angles (1–3 degrees) the motion is quite gentle and suitable for applications that are shear sensitive or that generate foam. With larger tilt angles (5–10 degrees) the fluid reaches a higher velocity during each cycle and the increased momentum generates more turbulence and is thus more useful for dissolution applications. It should be noted that the resonant frequency is not especially dependent on the tilt angle and the required motion of the inducing platform is essentially the same regardless of the tilt angle. By using baffles and sloping the container bottom it is even possible to produce breakers that further enhance the mixing efficiency.

The motion of the inducing platform is one of rapid acceleration from one end of the tilt angle to the other side, a waiting period, and then a quick reversal back to the starting point, and another waiting period. The cycle repeats endlessly. The timing of the cycle can be computed as described earlier, or can be controlled by sensors that detect the location of the center of gravity of the liquid in the container being rocked. As in any resonant process, multiple harmonics are possible. For example, the inducing motion could be such that two wave cycles are generated for every platform movement. Or the platform could be moved every four wave cycles or every eight wave cycles and so on. Obviously, using each lower harmonic reduces the energy required to mix. However, the most effective harmonic depending on the mixing intensity needed and the precise geometry of the container. In practice, getting four waves per induced platform movement appears to be optimum. This reduces the energy required to mix to 25% of what would be required for a continuously rocking platform.

The key feature of this method is the requirement to generate wave motion in the bag. This requires that the bag be flexible enough to permit wave formation. This is ensured by not filling the bag to full volume thereby allowing sufficient flexure. Alternatively, wave action may be ensured by partially inflating the bag with an appropriate inert gas, such as nitrogen, with the liquid and other ingredients occupying the remainder of the bag. This also extends the use of this method and apparatus to mixing in rigid, but partially filled containers, such as bottles.

By performing the mixing in the primary storage container, this method provides containment and eliminates labor intensive cleaning and sterilization of additional mixing tanks. The gentle wave motion provides an intrinsically low shear environment and reduces damage due to foam. As there is no invasive mixer, the container can be "closed" so that no contaminants can be introduced from the environment nor are any hazardous materials released from the container.

The invention is useful in various industries, especially for handling sterile and hazardous materials contained in sealed pre-sterilized plastic bags.

A typical embodiment of the invention is shown in FIG. 1. The plastic bag 4 contains the ingredients and liquid 20 to be mixed. To ensure sufficient wave motion for mixing it is critical that the bag not be filled to full volume. Sufficient volume must be available in the bag to permit liquid motion and wave formation. Typically, the bag must not be filled beyond 80% of its total volume with the liquid containing the ingredients to be mixed. The exact limit will depend on the bag geometry employed.

The partially filled plastic bag 4 is placed in bag holder 6 that is in turn placed on the rocking platform 1. The bag holder is attached to the platform in a manner such that it does slip or fall off during motion. The platform can rock or tilt in one axis about the pivot point 2 which is rigidly attached to the base 3. In the preferred embodiment the platform is made of stainless-steel and the pivot point is a nylon bushing through which a stainless-steel shaft is passed. However, the rocking platform may consist of any other rigid materials such as plastic, fiberglass, stainless steel etc. Likewise, the pivot point may be a hinge, pin, bearing, or other similar device.

The rocking platform 1 may be moved through an angular range of 1° to 10° with respect to the base 3 by the alternate actuation of electric linear actuators 22. Other actuation means, such as a pneumatic or hydraulic cylinder or electric cam may also be employed.

Restraining clamps 5 secure the bag in the bag holder. Other means to secure the bag such as a rigid holder, tape or sleeve may also be used. It is critical that the bag be held securely to the platform to ensure that the bottom surface of the bag is flat and free of pockets where ingredients could settle. The bag holder 6 can have sloped sides or baffles to increase wave formation. In particular, sloped ends promote breaker formation and also support the bag so as to reduce stress on the bag during rocking.

Figure 2:
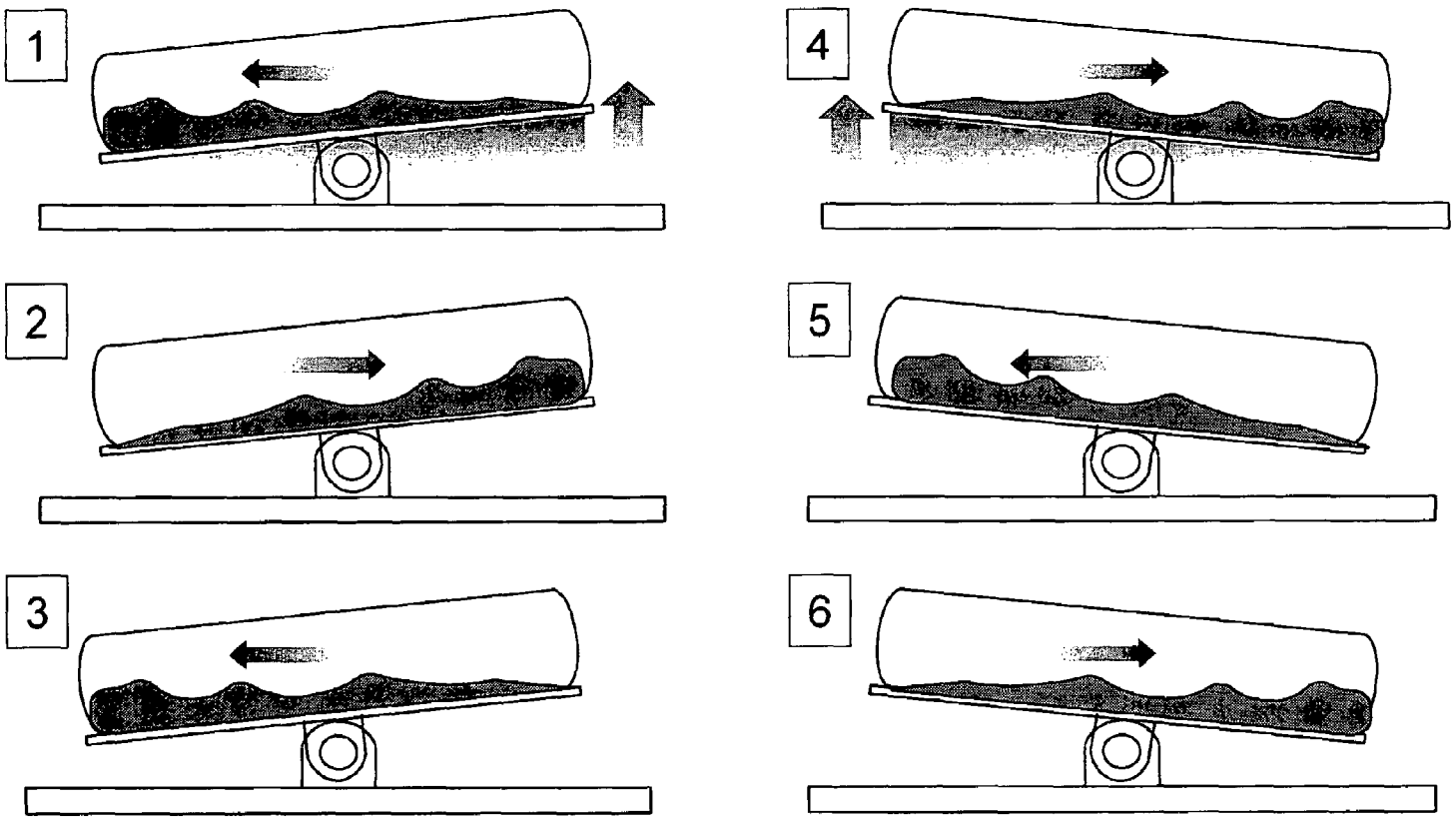
FIG. 2 shows the wave motion induced by intermittent tilting of the inducing platform.

The required resonant frequency can be calculated from the geometry of the bag holder and the speed. Alternatively, a few experiments at varying speed will quickly determine the speed at which resonant wave oscillation is observed. At any speed other than the resonant frequency the wave motion is either chaotic or damped. The required platform movement will be a submultiple of the resonant rocking speed depending on the harmonic desired. The rocking mechanism is then programmed to move and wait to produce the desired resonant motion. The tilt angle can be adjusted to change the intensity of agitation. The observed wave motion is shown diagrammatically in FIG. 2. In this figure the rocker only moves in panel 1 and panel 4. There are six wave motions caused by these two movements as depicted in panels 1 through 6.

The resonant speed may be determined in real time using load sensor under the bag holder to sense the shifting of weight as the liquid transfers from one side of the platform to another. At the resonant condition, the weight sensors exhibit a sinusoidal behavior.

Figure 4:
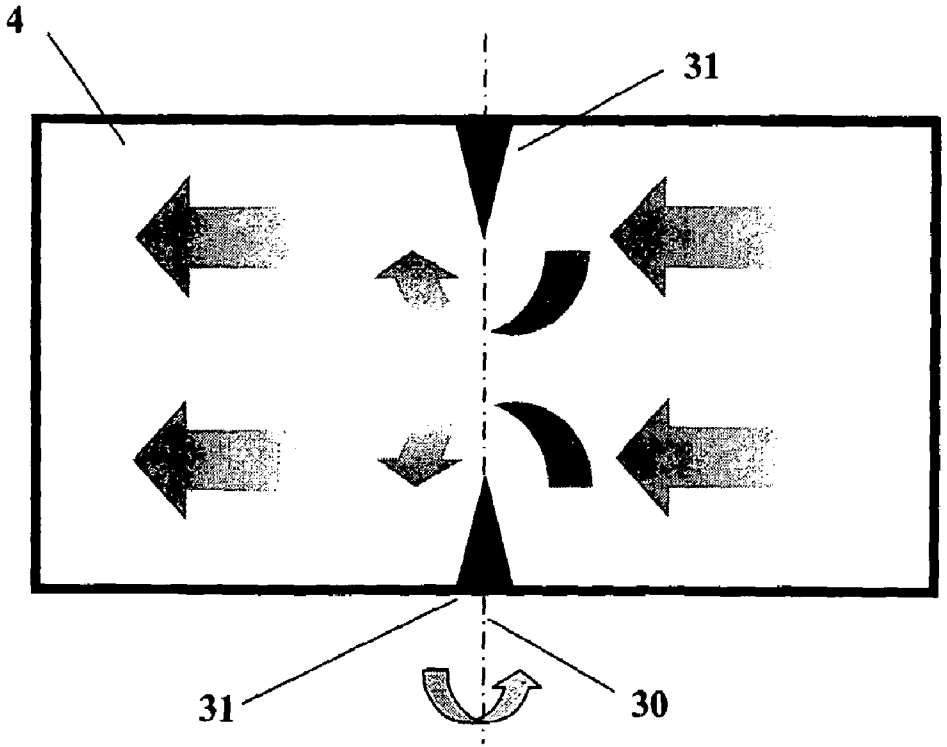
FIG. 4 shows baffles capable of producing a highly turbulent motion.

In the preferred embodiment, the device is operated by electric linear actuators. These devices are capable of rapid motion with the ability to achieve any desired acceleration and deceleration profile. They use position sensors to accurately control tilt angle and speed using feedback loops. In FIG. 4 an electronic motion controller 30 monitors the position, speed, and acceleration of the actuator 22 and controls it to the desired motion profile. A timing routine in the motion controller determines when to reverse motion. Alternatively, feedback signals from load sensors 23 can be used to regulate the timing.

EXAMPLE 1

Mixing in 1000 Liter Plastic Bags

Mixing performance was evaluated in trials using 1000 liter plastic bags. Bags were of "pillow" design and made of polyethylene. Bags were filled with water to varying percentages (80% maximum) of total volume and placed horizontally on the rocking platform as shown in FIG. 1. Mixing times under different conditions were evaluated by injecting a fluorescent dye into the bag and recording its dispersion by videotape. Mixing time was chosen to be that time after dye injection when the dye first appears to be completely dispersed throughout the contents of the bag.

The resonant frequency for the particular bag holder+bag was found by experiment to be 26.5 cycles per minute (cpm). At this condition, the resonant wave was very pronounced and the load sensors produced a constant sinusoidal output. Mixing experiments were performed at submultiples of this speed—13.25 cpm, 6.6 cpm, 3.2 cpm and 1.6 cpm. Various tilt angles ranging for 1 to 9 degrees (relative to horizontal datum) were tested.

When the bags were partially filled, excellent wave action induced by the rocking could be observed. The upper surface of the bag was observed to be rippling and flexing in response to the liquid motion inside the bag. Dye dispersion under these conditions was very rapid and complete homogeneity was typically observed in less than one minute. This is comparable to the best achievable mixing time for these volumes using a conventional mechanical mixer in a mixing tank. With increasing tilt angle the wave motion was more vigorous and angles over 7 degrees generated large rolling breakers. The optimal condition in terms of mixing efficiency and energy input was 6.6 cpm which resulted in four waves per rocker movement.

When the bags were filled to capacity no wave action could be observed. Dye dispersion was extremely slow and in many instances there were significant areas in the bag where no dye present even after several hours of rocking.

From this data it is clear that the resonant rocking motion generates waves that are extremely efficient in mixing components inside a non-rigid container, such as a bag. However, it is critical that observable wave motion be present. This was only possible when the bags are not completely filled with liquid.

EXAMPLE 2

Mixing in 1000 Liter Partially Inflated Plastic Bag

Tests were also performed by partially filling the bags with liquid and inflating the remainder of the bag to rigidity with air. Rocking these bags in the manner described in Example 1 also produced good wave motion and mixing times were slightly faster than reported in Example 1. However, significantly more foam was observed in this mode of operation.

Inflating the bag made it quite rigid and less creasing was observed during motion. It was apparent that an inflated bag undergoes less stress during motion and would be expected to be less prone to tearing, cracking and leakage during operation.

EXAMPLE 3

Mixing with Rotary Motion

Figure 3:
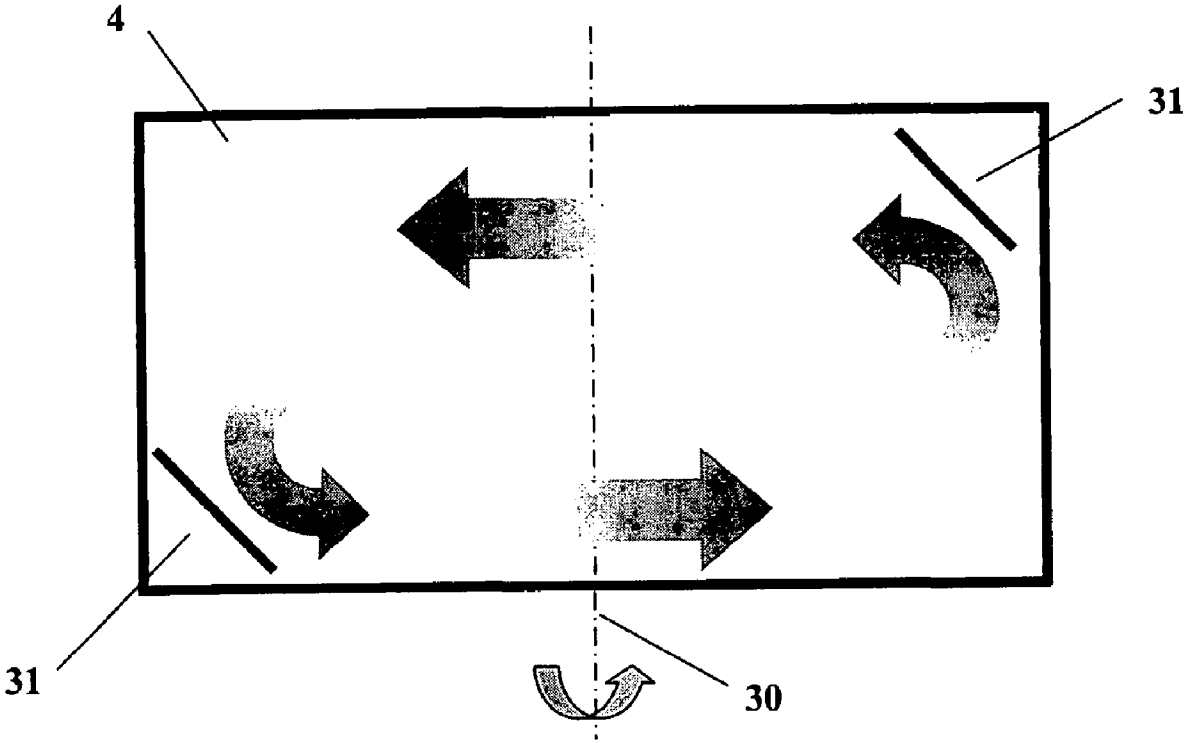
FIG. 3 shows baffles capable of producing a rotary motion.

In the earlier examples the wave motion occurs to and fro. The mixing is very quick in the axis perpendicular to the rocking axis but it much poorer in the parallel axis. By placing suitable baffles (FIG. 3) it is possible to cause the liquid to also rotate as it move to and fro. FIG. 3 shows the fluid circulation patterns in the bag in a top view with the platform tilted to the left. This rotary motion significantly reduces the mixing time and is very useful in applications where the ingredients to be mixed vary greatly in specific density.

EXAMPLE 4

Mixing Enhancement Using Baffles

In applications where it is necessary to suspend or dissolve particles it is desired to increase turbulence by introducing baffles over the pivot point as shown in FIG. 4 (also shown in top view tilted to the left). When the liquid passes the midpoint, these baffles reduce the flow cross-sectional area thereby increasing the fluid velocity and also creating fluid eddies. These combined effects quickly lift sedimented particles off the bottom and disperses them.

EXAMPLE 5

Mixing and Aeration for Cell Culture

The described wave motion when used with bags that have a gas headspace also promotes effective aeration. The mixing motion uniformly distributes cells and nutrients while the aeration provides oxygenation. Using resonant mixing reduces the energy needed to culture cells in bags and also minimizes damaging shear and foam.

EXAMPLE 6

Thawing Applications

By providing a heated bag holder it is possible to rapidly thaw frozen materials stored in bags. Material at the bottom of the bag in contact with the heated surface rapidly thaws and the resulting liquid is dispersed by the rocking motion accelerating further thawing. Since the system is mixed at all times the resulting thawed liquid is uniform and free of precipitates that are caused by concentration polarization and "salting out" effects common when using static thawing methods. Typical thaw rates using this device are 5 to 10 times faster that static methods and it produces uniform material of better quality. The heater temperature can be controlled to protect heat labile materials from damage.

As mentioned above, according to the present invention, the following advantages could be brought about:

(1) Provides a means for mixing ingredients in a bag or other non-rigid container by gentle wave agitation. Prior art utilized mechanical mixers that required materials to be pumped out of the bags and into dedicated mixing tanks, or utilized ineffective pump-around loops that compromise sterility and containment.

(2) In comparison to prior art, this invention allows the mixing of much larger volumes of materials in a single container or bag.

(3) The wave-induced mixing is very effective, and improves production efficiency by reducing the time required for mixing.

(4) Mixing can be accomplished in standard plastic bags commonly used for storage and transportation. This makes the method and apparatus of universal applicability. Prior art required the use of bags of specialized, complex, and costly construction.

(5) The mixing is possible without an invasive mixer thus preserving the sterile and contained environment inside the bag (6) The method and apparatus is simple in construction, thus reducing the cost to manufacture and operate.

(7) The method requires much less energy than prior art due to the effective and non-obvious use of natural resonance.

Although the present invention has been described in relation to particular embodiments thereof, many other variations and modifications and other uses will become apparent to those skilled in the art. The present invention therefore is not limited by the specific disclosure herein, but only by the claims.

What is claimed is:

1. A method of mixing ingredients and liquid in a container comprising tilting said container containing said ingredients and liquid through an angle on a platform from one side to the other back and forth with a pause in tilting motion at each side, wherein said pause is of a sufficient duration in order to allow for the creation of a resonant wave in said liquid, wherein each time said container is tilted, the resonant wave is reflected back and forth between a first end and a second end of said container a plurality of times.

2. The method of claim 1, wherein said container is a rigid container.

3. The method of claim 1, wherein said container is a flexible non-rigid container.

4. The method of claim 1, wherein said angle is from about 1 to about 10 degrees.

5. The method of claim 1, wherein said container is partially full of said ingredients.

6. The method of claim 5, wherein said container is filled with up to 80% capacity of said ingredients and liquid.

* * * * *